US012397189B2

(12) United States Patent
McGrotty et al.

(10) Patent No.: US 12,397,189 B2
(45) Date of Patent: Aug. 26, 2025

(54) WEIGHTLIFTING SYSTEM

(71) Applicant: Rep Fitness, LLC, Boulder, CO (US)

(72) Inventors: Ryan James McGrotty, Erie, CO (US); Joseph G. Larson, Boulder, CO (US); Samuel M. Pizer, Denver, CO (US)

(73) Assignee: Rep Fitness LLC, Westminster, CO (US)

( * ) Notice: Subject to any disclaimer, the term of this patent is extended or adjusted under 35 U.S.C. 154(b) by 118 days.

(21) Appl. No.: 18/084,883

(22) Filed: Dec. 20, 2022

(65) Prior Publication Data

US 2023/0218944 A1 Jul. 13, 2023

Related U.S. Application Data

(60) Provisional application No. 63/297,300, filed on Jan. 7, 2022.

(51) Int. Cl.
*A63B 21/00* (2006.01)
*A63B 21/062* (2006.01)

(52) U.S. Cl.
CPC ..... *A63B 21/156* (2013.01); *A63B 21/063* (2015.10); *A63B 21/0632* (2015.10); *A63B 21/4035* (2015.10)

(58) Field of Classification Search
CPC ..... A63B 21/063; A63B 21/4035; A63B 21/0628; A63B 21/062–0632; A63B 22/0076–0089; A63B 21/154–156
See application file for complete search history.

(56) References Cited

U.S. PATENT DOCUMENTS 4,339,125 A 7/1982 Uyeda
4,898,381 A 2/1990 Gordon
(Continued)

FOREIGN PATENT DOCUMENTS

CN 201949544 U 8/2011
CN 103550906 A 2/2014
(Continued)

OTHER PUBLICATIONS

REP Fitness, ARES Builder, published on Oct. 13, 2022 [online]. Retrieved from internet (Date: Sep. 12, 2023), https://repfitness.com/collections/specialty/products/ares-cable-attachment-builder (Year: 2022), 1 page.

(Continued)

*Primary Examiner* — Megan Anderson
*Assistant Examiner* — Catrina A Letterman
(74) *Attorney, Agent, or Firm* — NOD Law PC

(57) ABSTRACT

An exercise system includes a base structure including a first cross brace including first cross brace mounting plates disposed at each end of the first cross brace. A pair of base guide rail supports is secured to and extended substantially orthogonal from the first cross brace and includes a pair of base guide rail receivers. A pair of base pulley supports is secured to and extended substantially orthogonal from the first cross brace and further includes a pulley-support pulley housing. A pair of pulley-support pulleys is rotatably secured to the pulley-support pulley housing. A second cross brace includes a central portion substantially parallel to the first cross brace. The central portion is secured to the pair of base guide rail supports and the pair of base pulley supports. Two end portions are disposed at an angle to the central portion and terminate at second cross brace mounting plates disposed at each end of the two end portions and two central-portion pulley housings. A central-portion pulley is (Continued)

rotatably secured to each of the two central-portion pulley housings.

12 Claims, 11 Drawing Sheets

(56) References Cited

U.S. PATENT DOCUMENTS 4,907,798 A 3/1990 Burchatz
4,974,838 A 12/1990 Sollenberger
5,011,139 A 4/1991 Towley, III
5,094,449 A 3/1992 Stearns
5,298,004 A 3/1994 Davis
5,328,429 A * 7/1994 Potash ..... A63B 21/0058 482/99
5,374,229 A 12/1994 Sencil
5,476,428 A * 12/1995 Potash ..... A63B 21/063 482/99
5,665,036 A 9/1997 Hsieh
5,688,216 A 11/1997 Mauriello
5,954,619 A 9/1999 Petrone
5,971,897 A 10/1999 Olson
D428,949 S 8/2000 Simonson
6,102,835 A 8/2000 Webber
D437,370 S 2/2001 Webber
D438,267 S 2/2001 Webber
6,217,483 B1 4/2001 Kallassy
6,220,988 B1 4/2001 Williams
6,261,205 B1 7/2001 Elefson
6,565,490 B2 * 5/2003 O'Hearn ..... A63B 21/0628 482/102
6,685,601 B1 2/2004 Knapp
6,719,672 B1 4/2004 Ellis
D495,380 S 8/2004 Ceppo
D502,515 S 3/2005 Carter
D504,164 S 4/2005 Ceppo
D523,496 S 6/2006 Grider
7,070,546 B1 * 7/2006 Grasso ..... A63B 21/072 482/145
7,211,030 B1 5/2007 Cao
D557,758 S 12/2007 Fedriga
7,374,516 B2 5/2008 Lundquist
7,488,277 B1 2/2009 Knapp
7,608,024 B2 10/2009 Sechrest
7,632,221 B1 * 12/2009 Kolander ..... A63B 23/03525 482/102
7,641,602 B2 1/2010 Rogers et al.
7,837,600 B1 11/2010 Habing
D629,472 S 12/2010 Rhodes
7,918,771 B2 4/2011 Rogers et al.
8,002,677 B2 8/2011 Dibble et al.
8,147,390 B2 4/2012 Rogers et al.
8,257,233 B2 9/2012 Rogers et al.
8,491,449 B2 7/2013 Rogers et al.
8,657,726 B2 2/2014 Rogers et al.
8,876,675 B2 11/2014 Califano
9,011,301 B2 4/2015 Balandis
D734,410 S 7/2015 Childs
D735,820 S 8/2015 Alenaddaf
D735,821 S 8/2015 Alenaddaf
D737,387 S 8/2015 De Siqueira Indio da Costa
9,192,799 B2 11/2015 Alenaddaf
D746,387 S 12/2015 Alessandri
D755,908 S 5/2016 James
D757,189 S 5/2016 Colburn
9,327,161 B1 5/2016 Maher
9,597,539 B2 3/2017 Grider
D788,861 S 6/2017 Campanaro
9,669,251 B2 6/2017 Jones-Guinasso
D803,126 S 11/2017 Foley
D806,808 S 1/2018 Gregory
D808,475 S 1/2018 Meredith
9,895,572 B2 2/2018 Donato
9,907,991 B2 3/2018 Leipheimer
D818,547 S 5/2018 Meredith
9,999,796 B2 6/2018 Leipheimer
D841,014 S 2/2019 Laudadio
10,226,661 B2 3/2019 Henniger
10,293,206 B2 5/2019 Kamins
D852,291 S 6/2019 Meredith
D852,907 S 7/2019 Sergakis
D853,404 S 7/2019 Bowman
D854,637 S 7/2019 Adams
10,486,010 B1 11/2019 Leipheimer
D871,468 S 12/2019 Delvaux
D883,405 S 5/2020 Dunahay
D883,406 S 5/2020 Sergakis
10,646,744 B2 5/2020 Steenkamp et al.
D888,850 S 6/2020 Smith, Jr.
D890,271 S 7/2020 Carmichael et al.
D890,867 S 7/2020 Carmichael et al.
D892,239 S 8/2020 Carmichael et al.
D893,639 S 8/2020 Henniger
D896,326 S 9/2020 Adams
D898,136 S 10/2020 Carmichael et al.
D898,137 S 10/2020 Carmichael
10,792,532 B1 10/2020 Hall
10,799,749 B2 10/2020 Sorin
D903,793 S 12/2020 Henniger
10,857,416 B2 12/2020 Leipheimer
10,864,404 B2 12/2020 Leipheimer
10,953,301 B2 3/2021 Brasch et al.
D920,451 S 5/2021 McGrotty
11,103,738 B2 8/2021 Sorin et al.
11,110,313 B2 * 9/2021 Gore ..... A63B 21/0783
11,117,015 B2 9/2021 Steenkamp et al.
11,173,337 B2 11/2021 Jones et al.
D949,262 S 4/2022 Horita
D954,864 S 6/2022 Carmichael et al.
D954,867 S 6/2022 Carmichael et al.
D955,511 S 6/2022 Carmichael et al.
2002/0193213 A1 12/2002 Batca et al.
2003/0017918 A1 1/2003 Webb
2003/0115955 A1 6/2003 Keiser
2004/0259696 A1 12/2004 Shifferaw
2005/0202941 A1 9/2005 Vaes
2006/0030461 A1 2/2006 Ish, III
2006/0030462 A1 2/2006 Ish, III
2006/0217245 A1 9/2006 Golesh
2007/0155595 A1 7/2007 Rogers
2007/0155597 A1 7/2007 Hockemeyer
2008/0287270 A1 * 11/2008 Carter ..... A63B 23/12 482/99
2008/0312051 A1 12/2008 Manyseng
2009/0124469 A1 5/2009 Webber
2009/0203500 A1 8/2009 Nishimura
2009/0247376 A1 * 10/2009 Merrithew ..... A63B 23/1263 482/121
2010/0022363 A1 1/2010 Fenster et al.
2011/0237405 A1 * 9/2011 Reyes ..... A63B 21/0628 482/94
2013/0035220 A1 2/2013 Adams
2013/0296144 A1 * 11/2013 Gvoich ..... A63B 21/062 482/102
2013/0296146 A1 11/2013 Staten
2014/0135185 A1 5/2014 Dalebout
2015/0159804 A1 6/2015 Bowman
2015/0352395 A1 12/2015 Gregory
2016/0074688 A1 3/2016 Leipheimer
2017/0246496 A1 8/2017 Nelson
2017/0246504 A1 8/2017 Simmons
2018/0117382 A1 5/2018 Johanson
2018/0353795 A1 12/2018 Ostmeyer
2019/0134450 A1 * 5/2019 Kuo ..... A63B 21/154
2019/0240521 A1 8/2019 Staten
2019/0269992 A1 9/2019 Dunahay
2019/0275363 A1 9/2019 Jones
2019/0308069 A1 10/2019 Sandhu
2020/0038704 A1 2/2020 Adams
2020/0114195 A1 4/2020 Henniger
2020/0155889 A1 * 5/2020 Leipheimer ..... A63B 21/156
2020/0179744 A1 6/2020 Arroyo
2020/0222745 A1 * 7/2020 Leipheimer ..... A63B 23/03525

(56) References Cited

U.S. PATENT DOCUMENTS

| | | | | |
|---|---|---|---|---|
| 2021/0060374 | A1 | 3/2021 | Slater | |
| 2021/0379438 | A1 | 12/2021 | Sorin et al. | |
| 2022/0096893 | A1 | 3/2022 | Steenkamp et al. | |
| 2022/0105380 | A1 | 4/2022 | Jones et al. | |
| 2022/0314055 | A1* | 10/2022 | Wuttke | A63B 22/203 |
| 2023/0118879 | A1* | 4/2023 | Yang | A63B 21/0442 482/138 |
| 2024/0131387 | A1* | 4/2024 | Yang | A63B 21/4043 |
| 2024/0226643 | A9* | 7/2024 | Yang | A63B 21/0628 |

FOREIGN PATENT DOCUMENTS

| | | |
|---|---|---|
| CN | 203539969 U | 4/2014 |
| CN | 202230408621.9 | 6/2022 |
| EP | 1125599 | 8/2001 |
| KR | 3019970012320 | 6/1998 |
| KR | 102282747 | 7/2021 |
| WO | 2006008767 | 1/2006 |
| WO | 2018/086028 | 5/2018 |

OTHER PUBLICATIONS

Garage Gym Reviews, REP Fitness ARES Cable Attachment, published on Sep. 28, 2022 [online]. Retrieved from internet (Date: Sep. 12, 2023), https://www.youtube.com/watch?v=yw2V9DdnuU (Year: 2022), 1 page.

Major Lutie, Multifunction Power Cage, published on Feb. 3, 2023 [online]. Retrieved from internet (Date: Sep. 13, 2023), https://www.amazon.com/dp/B0BVLM5B95/?th=1 (Year: 2023), 1 page.

Major Lutie, Multi-Function Power Rack, published on Mar. 22, 2022 [online]. Retrieved from internet (Date: Sep. 13, 2023), https://www.amazon.com/MAJOR-LUTIE-Multi-Function-Adjustable-Attachments/dp/B09W5N8HY3/?th=1 (Year: 2023), 1 page.

Marcy, Machine Cage System, published on Oct. 8, 2019 [online]. Retrieved from internet (Date: Sep. 13, 2023), https://www. amazon.com/Marcy-Multifunction-Customizable-Training-SM-4033/dp/B07YVTW8ZF/?th=1 (Year: 2019), 1 page.

Marcy, Stack Home Gym Multifunction, published on Apr. 13, 2015 [online]. Retrieved from internet (Date: Sep. 12, 2023), https://www.amazon.com/dp/B00XHNB4CA/ (Year: 2015), 1 page.

REP Fitness, ARES Attachment (6-Post-Pre-Selected), published on Oct. 13, 2022 [online]. Retrieved from internet (Date: Sep. 13, 2023), https://repfitness.com/collections/specialty/products/ares-6-post-pre-selected (Year: 2022), 2 pages.

Spart, Functional Trainer Cable Machine, published on May 24, 2023 [online]. Retrieved from internet (Date: Sep. 12, 2023), https://www.amazon.com/dp/B0C66CYYCQ/?th=1 (Year: 2023), 1 page.

Xmark, Functional Trainer Cable Machine, published on May 10, 2012 [online]. Retrieved from internet (Date: Sep. 12, 2023), https://www.amazon.com/dp/B008230QHU/?th=1 (Year: 2012), 1 page.

Belt Squat by Rep Fitness dated Jul. 9, 2020. Found online [Jan. 7, 2021] https://www.youtube.com/watch?v=9wn6IYVKIXY (Year: 2020).

The Fitness Outlet, BodyCraft RFT Rack Functional Trainer, located online on Mar. 6, 2023 at: https://www.thefitnessoutlet.com/bodycraft-rft-rack-functional-trainer/?utm_source=google&utm_medium=cse&utm_term=5090&gclid=CjwKCAiA5sieBhBnEiwAR9oh2kPf6ZzAr_PHj9zMpMT5x-DmhUOizW0O2LvytpV9TtEiv7j9gus9PROCqF8QAvD_BWE, offered for sale as early as Jan. 7, 2022, 6 pages.

Internet Archive Wayback Machine, BodyCraft RFT Rack Functional Trainer, for link https://www.bodycraft.com/product/f430-f438-rft; located online on Nov. 28, 2020 at: http://web.archive.org/web/20210121031323/https://www.bodycraft.com/product/f430-f438-rft/, 3 pages.

Internet Archive Wayback Machine, Rogue LP-2 Lat Pulldown Low Row, for link https://www.roguefitness.com/rogue-p-2-lat-pulldown-low-row, located at http://web.archive.org/web/20200812230501/https://www.roguefitness.com/rogue-p-2-lat-pulldown-low-row, dated Aug. 12, 2020, 4 pages.

Internet Archive Wayback Machine, Prime HLP Selectorized Rack, for link https://primefitnessusa.com/hlp-selectorized-rack/, located at: http://web.archive.org/web/20210123003723/https://primefitnessusa.com/hlp-selectorized-rack/, dated Aug. 14, 2020, 3 pages.

European Extended Search Report in Application 23150155.2, mailed May 31, 2023, 7 pages.

Vendetta Strength and Athletics, Titan Lever Arm—180 degree Adapter Mounts (Pair), located online at: https://vendettastrengthandathletics.com/products/adjustable-lever-arm-titan-adapter-mounts-pair, captured on WayBack Internet Archive on Oct. 20, 2022, 5 pages.

Garage Gym Outfitters, Crandall Fitness Adjustable Free Motion Swing Arms, located online on Mar. 6, 2023 at: https://thegaragegymoutfitters.com/products/crandall-fitness-adjustable-free-motion-swing-arms, 5 pages.

Griffin Fitness, Griffin Adjustable Lever Arms, located online at: https://griffin.fitness/rack-attachments/griffin-adjustable-lever-arms/, captured on WayBack internet Archive on Feb. 10, 2022, 4 pages.

Rep Fitness, ISO Arms, located online on Mar. 6, 2023 at: https://repfitness.com/products/iso-arms?psafe_param=1&gclid=CjwKCAjw8symBhAqEiwAaTA_HEoleFUX_hO9PcY99fM57nLRuNt7bRws9hJAIQs_Bmb74I0F3RatRoCe2QQAvD_BwE, 6 pages.

USA Home Gym, Inspire Fitness SCS Smith Cage Sytem Review, published Aug. 4, 2014, https://www.USA-homegym.com/smith-machine/inspire-fitness-scs-smith-cage-system/, printed on Oct. 13, 2023, 6 pages.

Flame Sport Professional Gym Equipment, Multifunctional Power Rack (9B), published Jul. 12, 2017 on Wayback Machine, https://www.flame-sport.de/en/multifunctional-power-rack-9b.html, printed on Oct. 13, 2023, 5 pages.

Danboarding, You Tube video, FIT505 Universal Functional Smith Machine, published on Oct. 7, 2017, https://www.youtube.com/watch?v=gpkoV9GopzA, duration 6:43, 6 pages.

BRUTEforce Australia, You Tube video, Exercise Guide—BRUTEforce 360PTA Functional Trainer—Renouf Fitness, published Oct. 20, 2017, https://www.youtube.com/watch?v=fVBu7j6uZkc, duration 7:54, 1 page.

European patent application No. 23150155.2, Communcation Pursuant to Article 94(3) EPC dated Jan. 15, 2025. 4 pages.

* cited by examiner

WEIGHTLIFTING SYSTEM

CROSS-REFERENCE TO RELATED APPLICATIONS

This application claims the benefit of priority to U.S. Provisional Application No. 63/297,300, filed Jan. 7, 2022, which is hereby incorporated in its entirety by reference.

INTRODUCTION

A variety of machines exist to train specific muscles or muscle groups. For example, leg curl machines may be used to exercise the hamstrings, while leg extension machines may be used to exercise the quadriceps. For the upper body, pull-down machines are used to exercise the latissimus dorsi, while so-called "pec decks" may be used to exercise the pectorals. Other specific machines for specific body parts are known. Functional trainers, however, may be used to exercise multiple body parts, but due to their versatility, these machines are often exceedingly large. Further, due to the complexity thereof, functional trainers are often very expensive pieces of exercise equipment, making them cost-prohibitive for home gym users or even commercial gyms with limited budgets.

SUMMARY

In one aspect, the technology relates to an exercise system including: a base structure including: a first cross brace including first cross brace mounting plates disposed at each end of the first cross brace; a pair of base guide rail supports secured to and extending substantially orthogonal from the first cross brace, wherein each of the pair of base guide rail supports includes a pair of base guide rail receivers; a pair of base pulley supports secured to and extending substantially orthogonal from the first cross brace, wherein each of the pair of base pulley supports further includes: a pulley-support pulley housing; and a pair of pulley-support pulleys rotatably secured to the pulley-support pulley housing; and a second cross brace including: a central portion substantially parallel to the first cross brace, wherein the central portion is secured to the pair of base guide rail supports and the pair of base pulley supports; two end portions disposed at an angle to the central portion, wherein each of the two end portions terminate at second cross brace mounting plates disposed at each end of the two end portions; two central-portion pulley housings; and a central-portion pulley rotatably secured to each of the two central-portion pulley housings. In an example, the exercise system further includes a pair of weight stack units, wherein each of the pair of weight stack units includes: a pair of weight stack guide rails, wherein each of the pair of weight stack guide rails are secured at lower ends to one of the pair of base guide rail receivers on a same one of the pair of base guide rail supports; a movable weight stack slidably engaged with the pair of weight stack guide rails; and a lifting rod selectively engageable with the movable weight stack. In another example, the exercise system further includes an upper structure including: a third cross brace including third cross brace mounting plates disposed at each end of the third cross brace; a pair of upper guide rail supports secured to and extending substantially orthogonal from the third cross brace, wherein each of the pair of upper guide rail supports includes a pair of upper guide rail receivers, and wherein each of the pair of weight stack guide rails are secured at upper ends to one of the pair of upper guide rail receivers on a same one of the pair of upper guide rail supports; a pulley support plate fixed to each of the pair of upper guide rail supports, wherein each pulley support plate includes a pair of pulley-support plate pulley housings and a pulley-support plate pulley rotatably secured to each of the pair of pulley-support plate pulley housings; and a fourth cross brace including: two end plates, wherein each of the two end plates is secured to a single one of the pair of upper guide rail supports; a spanner connected to each of the two end plates; two spanner pulley housings secured to the spanner; and a pulley rotatably secured to each of the two spanner pulley housings. In yet another example, the base structure further includes a foot plate slidably secured to the central portion of the base structure. In still another example, the exercise system further includes a pair of upper outer pulley bracket units, each including a bracket, a pair of upper outer pulley housings secured to the bracket, and an upper outer pulley rotatably secured to each of the pair of upper outer pulley bracket units.

In another example of the above aspect, the exercise system further includes a pair of lower outer pulley bracket units, each including a bracket, three lower outer pulley housings secured to the bracket, and a lower outer pulley rotatably secured to each of the three of the lower outer pulley housings. In an example, the exercise system further includes a floating pulley unit disposed between each of the upper outer pulley bracket units and lower outer pulley bracket units, wherein each floating pulley unit includes a pair of floating pulleys rotatably coupled to a floating pulley housing. In another example, the exercise system further includes a pair of front upper pulley brackets, wherein each of the front upper pulley bracket units includes a bracket, a housing secured to the bracket, and a front upper pulley rotatably secured to the housing; and a pair of front lower pulley brackets, wherein each of the front lower pulley bracket units includes a bracket, a housing secured to the bracket, and a front lower pulley rotatably secured to the housing. In yet another example, the exercise system further includes a trolley disposed between each of the pair of front upper pulley bracket units and each of the pair of front lower pulley bracket units, wherein each trolley includes: a receiver; a pin coupled to the receiver for selectively securing the receiver to a frame; a handle secured to the receiver; and a roller rotatably secured to the receiver. In still another example, the exercise system further includes a cable for rotatably coupling any two of the plurality of pulleys.

BRIEF DESCRIPTION OF THE DRAWINGS

The following drawing figures, which form a part of this application, are illustrative of described technology and are not meant to limit the scope of the disclosure as claimed in any manner, which scope shall be based on the claims appended hereto.

DETAILED DESCRIPTION

Figure 1:
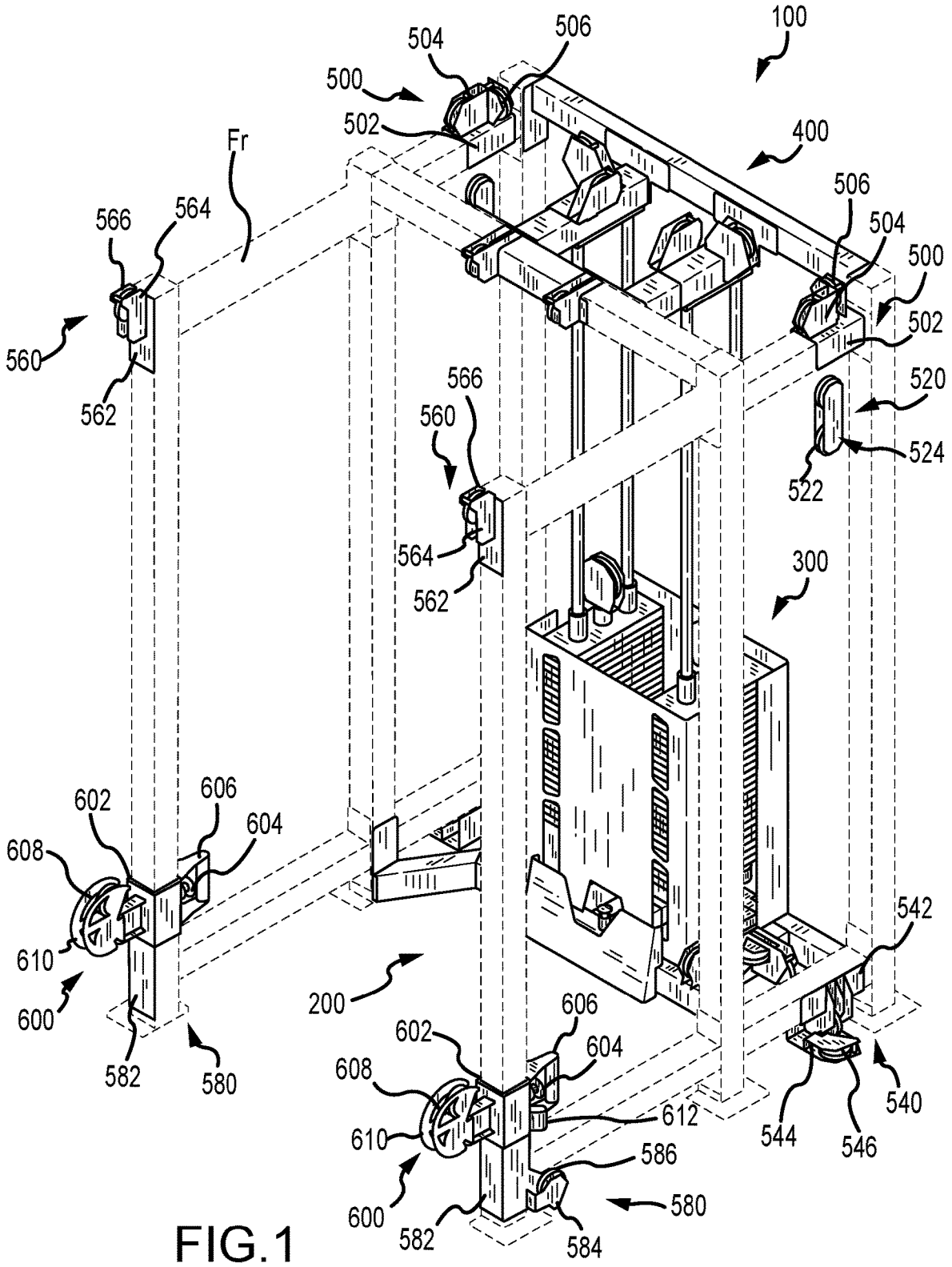
FIG. 1 depicts a perspective view of a weightlifting system, mounted to a frame.

FIGS. 1-5 depict various views of a weightlifting system 100, which may also be referred to herein as a functional trainer or exercise system, as well as components thereof. The figures are described concurrently and not all components of the weightlifting system 100 are depicted or labeled in every figure. In FIG. 1, a frame structure Fr is depicted. The frame structure Fr may be formed of steel or other robust metal tubing sized as required or desired for a particular application, e.g., 1-½", 2", 3" and larger. Tubing formed of 12G, 10G, 8G, and larger gauge materials are contemplated. The steel tubing of the frame is perforated at regular intervals with openings sized to receive bolts, pins, screws, or other elongate elements that project from the various components that make up the weightlifting system 100. For clarity, the components of the weightlifting system 100 that are described elsewhere herein are depicted in solid line.

The various components of the weightlifting system 100 may be attached to the frame Fr or other components of the weightlifting system 100 with one or more of mounting plates, brackets, or receivers. As used herein, the term "mounting plate" refers to a flat plate or multiple plates defining one or more openings for receiving a bolt, pin, or other elongate element that may be used to secure the mounting plate to the frame Fr. In examples, mounting plates are attached to ends of components and are secured via bolts to adjacent components or the frame Fr; in other examples, mounting plates may be welded to adjacent components or the frame Fr. Brackets are similar to mounting plates and may include one or more flat plates to secure components to adjacent components or the frame Fr. In other examples, brackets may be welded to other components or the frame Fr. Finally, in examples, the term "receiver" contemplates two or more flat plates into which a portion of the frame Fr are received or inserted. Certain of the mounting plates, brackets, or receivers may be selectively movable and/or positionable. In examples, it may be advantageous to utilize bolts or pins or other removable elements to secure the mounting plates, brackets, and receivers to the frame Fr or other components of the weightlifting system 100. Use of mechanical fasteners may enable an end user to install the weightlifting system on their own frame Fr. Welded components may typically be more appropriate for components shipped fully assembled from a manufacturer. Regardless, the type of connection elements (mounting plate, bracket, receiver, etc.) and the type of connection to an adjacent element (bolt, weld, pin, etc.) should not be considered limiting. The functional trainer described herein is depicted for illustrative purposes only for certain contemplated configurations; other configurations would be apparent to a person of skill in the art.

The exercise or weightlifting system 100 includes a base structure 200, a weight system 300 including pair of weight stacks, and an upper structure 400, along with a number of pulleys located remote therefrom. The base structure 200 includes a first cross brace 202 having first cross brace mounting plates 204 disposed at each end of the first cross brace 202. These mounting plates 204 are secured to the frame Fr, with bolts or other fasteners (not shown). A pair of base guide rail supports 206 are secured to and extending substantially orthogonal from the first cross brace 202. Each of the pair of base guide rail supports 206 define a pair of base guide rail receivers 208. The base guide rail receivers 208 may be openings in the base guide rail supports 206, or may be a separate structure (e.g., tubing, plate, or other structure) that may receive a bottom end of the guide rails of the weight stacks (described in more detail below). A pair of base pulley supports 210 are secured to and extend substantially orthogonal from the first cross brace 202. As such, each of the base pulley supports 210 are substantially parallel to the base guide rail supports 206. Each of the pair of base pulley supports 210 include a pulley-support pulley housing 212, which extends from the base pulley support 210, generally away from an axis X, as depicted, e.g., in FIG. 5. A pair of pulley-support pulleys 214 are rotatably secured to the pulley-support pulley housing 212, generally about axles that are skew relative to each other. The pulley-support pulleys 214 allow for redirection of a cable (not depicted in this figure), as do the other pulleys in weightlifting system 100.

Secured to opposite ends of the base pulley supports 210 and the base guide rail supports 206 is a second cross brace 216. The second cross brace 216 includes a central portion 218 that is substantially parallel to the first cross brace 202. The central portion 218 is secured to the pair of base guide rail supports 206 and the pair of base pulley supports 210. Further, two central-portion pulley housings 220 each have rotatably attached thereto a central-portion pulley 222. The second cross brace 216 also includes two end portions 224 disposed at an angle to the central portion 218. In examples, the angle may be about 105°, about 110° about 115°, about 120°, about 125°, and about 130°. In examples, the angle may be between about 110° and about 130°, or between about 115° and about 125°. In other examples, the angle may be about 121°, about 122°, about 123°, and about 124°. The angled offset from the central portion 218 allows the major components of the weightlifting system 100 to be more compact, and to be set farther back within the frame Fr depicted in FIG. 1, while still being attachable to a vertical portion of the frame Fr at second cross brace mounting plates 226 disposed at each end of the two end portions 224. A receiver 228 may be configured to receive a post 230 extending from a foot plate 232, which may enable additional exercises with the weightlifting system 100. A distance between the central portion 218 and the foot plate 232 may be adjustable by selective operation of an adjustment pin 234.

Resistance to exercises performed with the weightlifting system 100 is provided by the weight system 300. The depicted weight system 300 includes two movable weight stack units 302. The weight stack units 302 may include selectively removable pins (not shown) for selecting a desired weight for a particular exercise. The pin projects into a lifting rod 304 and a lifting force of a cable around a weight stack pulley 306 lifts the selected portion of the weight stack unit 302 during exercise. When lifted and lowered, each weight stack unit 302 slides along a pair of weight stack guide rails 308. Each of the weight stack guide rails 308 are secured at lower ends to one of the pair of base guide rail receivers 208 on a same one of the pair of base guide rail supports 206. One or more shrouds 310 may substantially surround the weight stack units 302 to prevent inadvertent contact between a user and the moving weight stacks units 302 during movement.

The weightlifting system 100 also includes an upper structure 400, which includes a third cross brace 402. Third cross brace mounting plates 404 are disposed at each end of the third cross brace 402, for securing the third cross brace 402 to an upright or other portion of the frame Fr. A pair of upper guide rail supports 406 are secured to and extend substantially orthogonal from the third cross brace 402. In the depicted example, the upper guide rail supports 406 are secured to the third cross brace 402 with mounting plates 408. Each of the pair of upper guide rail supports 406 include a pair of upper guide rail receivers 410, which may be similar in configuration to the base guide rail receivers 208, into which each of the pair of weight stack guide rails 308 are secured at upper ends thereof, e.g., on a same one of the pair of upper guide rail supports 406. A pulley support plate or bracket 412 is fixed to each of the pair of upper guide rail supports 406. Each pulley support plate 412 includes a pair of pulley-support plate pulley housings 414. Each pulley support housing 414 has rotatably secured thereto a pulley-support plate pulley 416. In examples, the pairs of pulley support housings 414 on a single one of the upper guide rail supports 406 may be constructed as a single housing, such as the pulley-support pulley housing 212, depicted above. The upper structure 400 further includes a fourth cross brace 418 that, in this example, is constructed of a number of parts. Here, two end plates 420 are secured to individual ends of each of the upper guide rail supports 406. These two end plates 420 are joined via a spanner 422. The spanner 422 is configured as a bracket to substantially surround a portion of tubing that forms a part of the frame Fr. Two spanner pulley housings 424 are secured to the spanner 422 and each include a spanner pulley 426 rotatably secured thereto.

The base structure 200, weight system 300, and upper structure 400 form the majority of the components of the weightlifting system 100. A plurality of pulleys are also utilized to guide a plurality of cables to enable a wide range of range exercises. A pair of upper outer pulley bracket units 500 are disposed proximate and on each side of the upper structure 400. Each upper outer pulley bracket unit 500 includes a bracket 502, and a pair of upper outer pulley housings 504 secured to the bracket 502. In examples, the pairs of upper outer pulley housings 504 on a single one of the brackets 502 may be constructed as a single housing, such as the pulley-support pulley housing 212, depicted above. Regardless, two upper outer pulleys 506 are rotatably secured to each of the brackets 502, via one or more housings 504. Disposed below each upper outer pulley bracket unit 500 is a floating pulley unit 520. Each floating pulley unit 520 includes a pair of floating pulleys 522 rotatably coupled to a floating pulley housing 524. Disposed below each floating pulley unit 520 is a lower outer pulley bracket unit 540, each of which includes a bracket 542. Depending on configuration, one, two or three lower outer pulley housings 544 may be secured to the bracket 542. A lower outer pulley 546 is rotatably secured to each of the brackets 542, via the lower outer pulley housings 544.

Proximate a front of the frame Fr are a pair of front upper pulley bracket units 560 and a pair of front lower pulley bracket units 580. Each of the front upper pulley bracket units 560 includes a bracket 562 and a housing 564 secured to the bracket 562. A front upper pulley 566 is rotatably secured to the housing 564. Similarly, each of the front lower pulley bracket units 580 includes a bracket 582 and a housing 584 secured to the bracket 582. A front lower pulley 586 is rotatably secured to the housing 584. Disposed between each of the pair of front upper pulley bracket units 560 and each of the pair of front lower pulley bracket units 580 is a trolley 600, which is positionable vertically along from the frame Fr, in examples, as high as the front upper pulley bracket unit 560 and as low as front lower pulley bracket unit 580. Each trolley 600 includes a receiver 602 that is positionable along a portion of the frame Fr to which it is mounted. A pin 604 is coupled to the receiver 602 for selectively securing the receiver 602 to the frame Fr. A handle 606 is secured to the receiver 602 to aid in allowing a user of the weightlifting system 100 in positioning the trolley 600 vertically between the front upper pulley bracket units 560 and the front lower pulley bracket units 580. At least one roller 608 is rotatably secured to the receiver 602, e.g., via a housing 610. In examples, multiple rollers 608 may be rotatably secured to each housing 610. A cable anchor 612 projects from the receiver 602.

Figure 2:
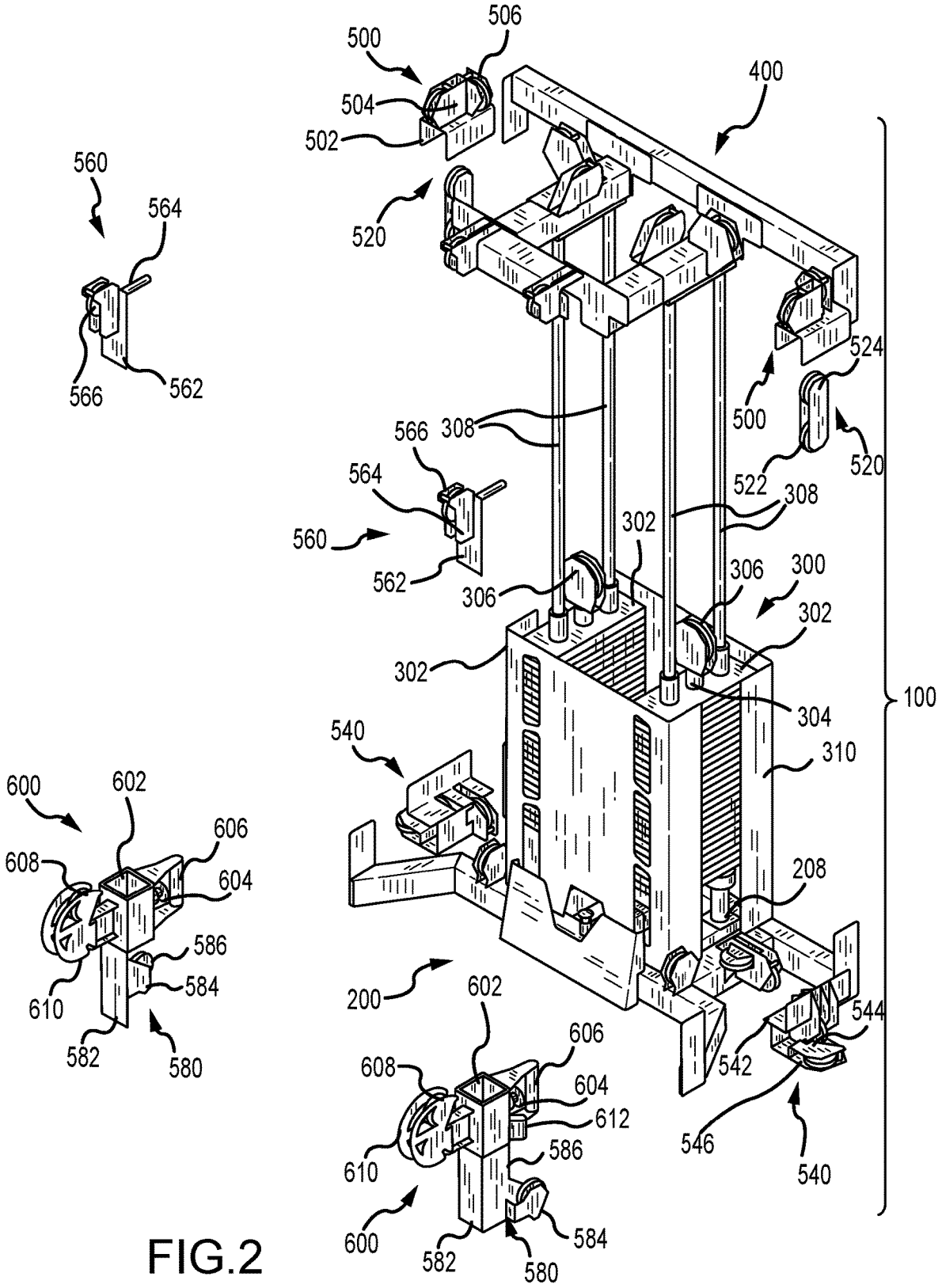
FIG. 2 depicts a perspective view of the weightlifting system of FIG. 1, without the frame.
Figure 3:
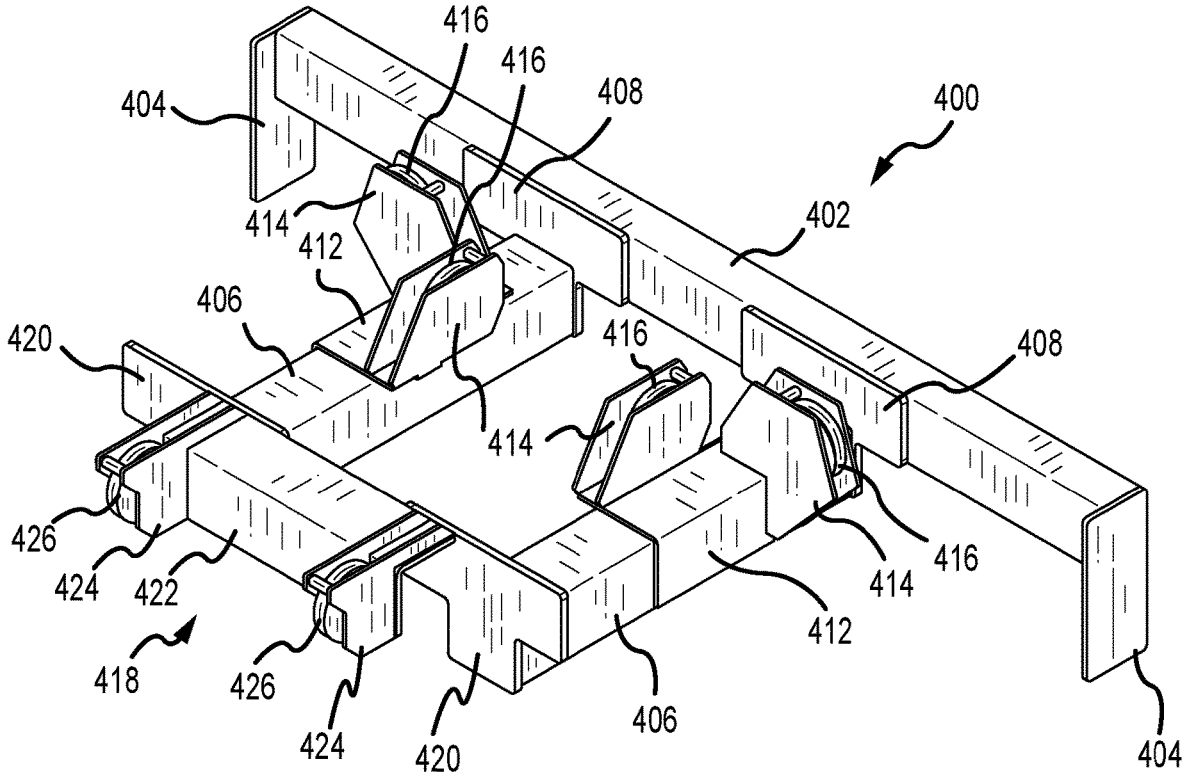
FIG. 3 depicts an enlarged upper perspective view of an upper structure of the weightlifting system of FIG. 2.
Figure 4:
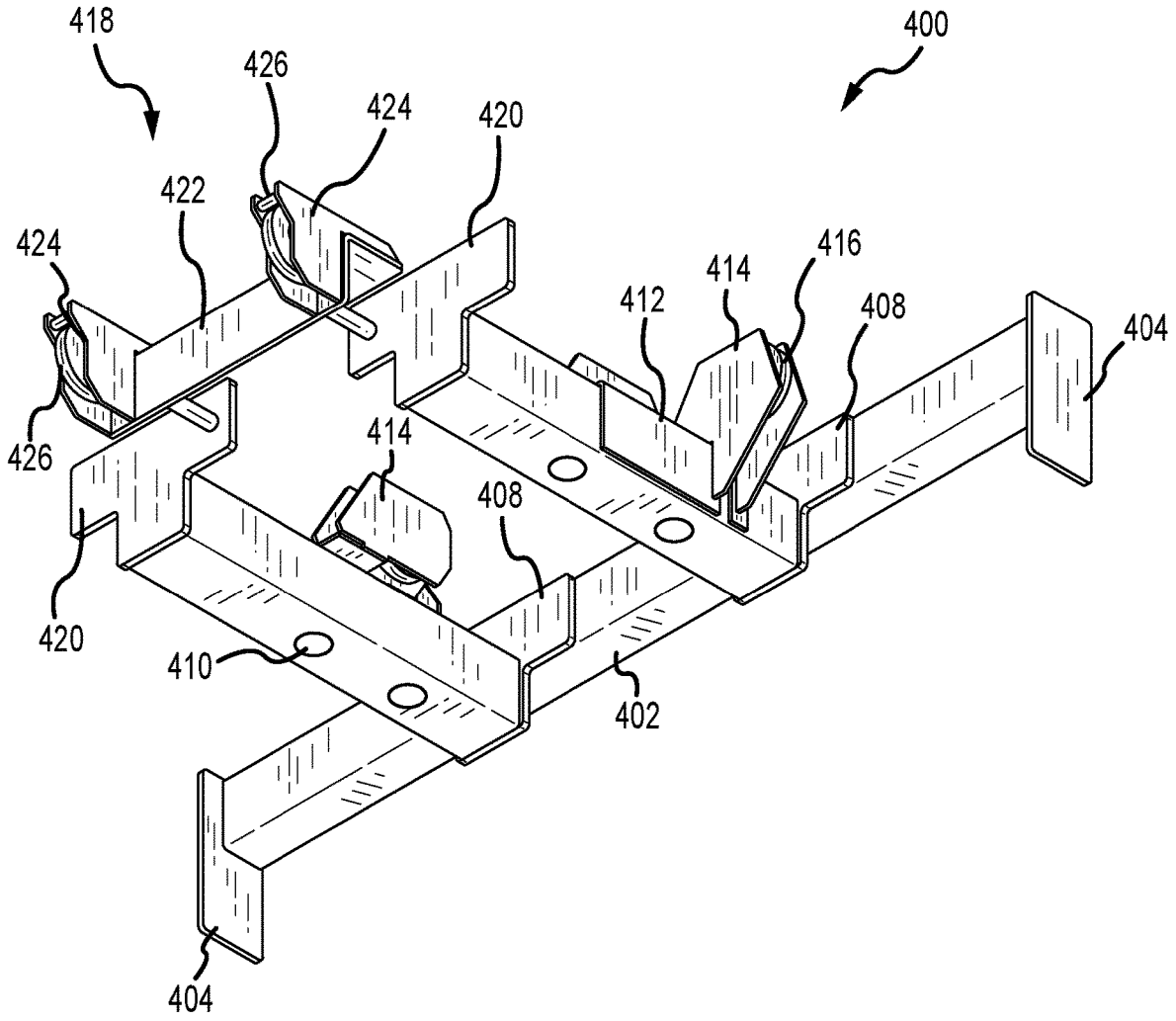
FIG. 4 depicts an enlarged lower perspective view of the upper structure of FIG. 3.
Figure 5:
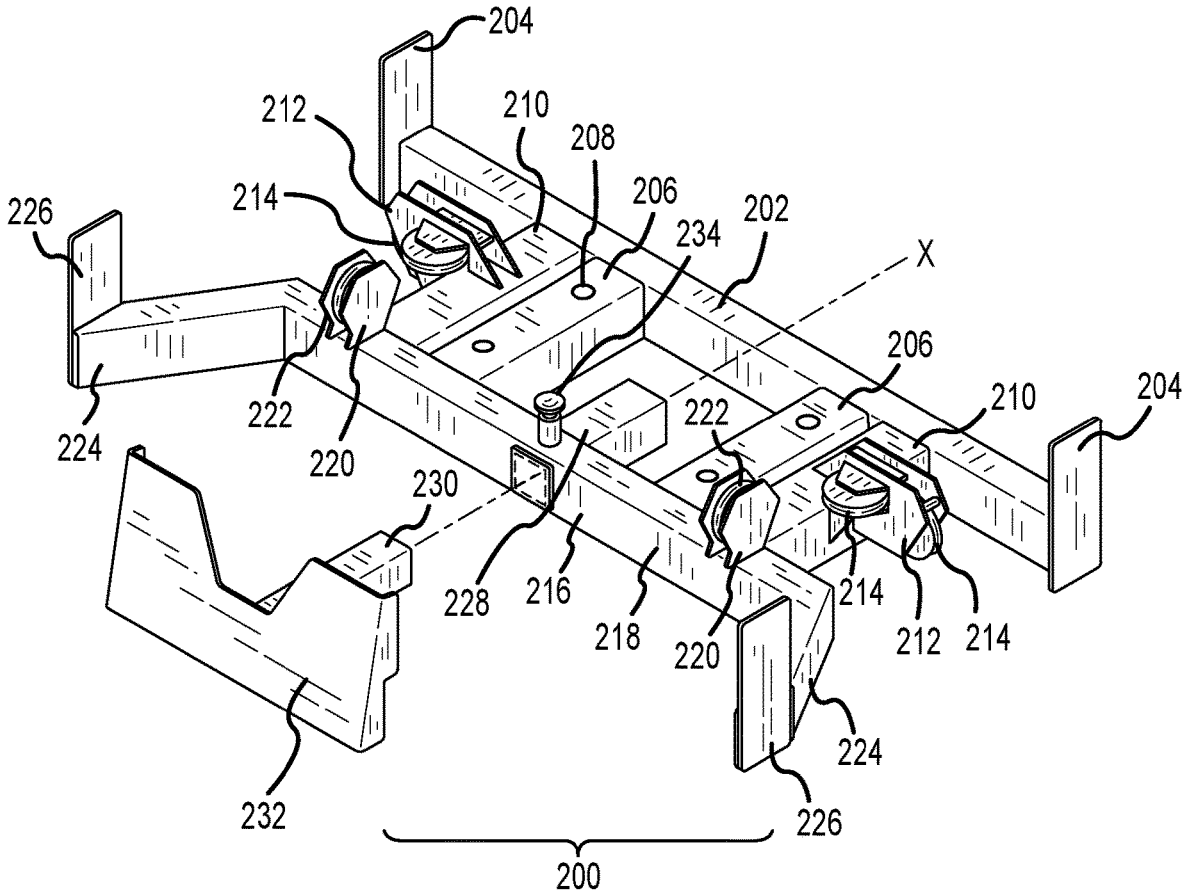
FIG. 5 depicts a partially exploded, enlarged upper perspective view of a base structure of the weightlifting system of FIG. 2.
Figure 6:
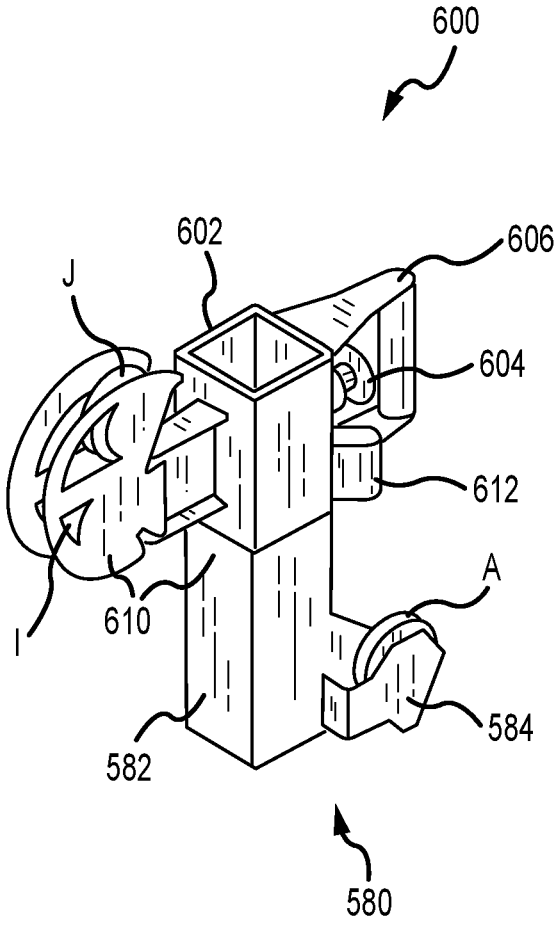
FIG. 6 depicts an enlarged upper perspective view of a trolley and a front lower pulley bracket unit of the weightlifting system of FIG. 2.
Figure 7:
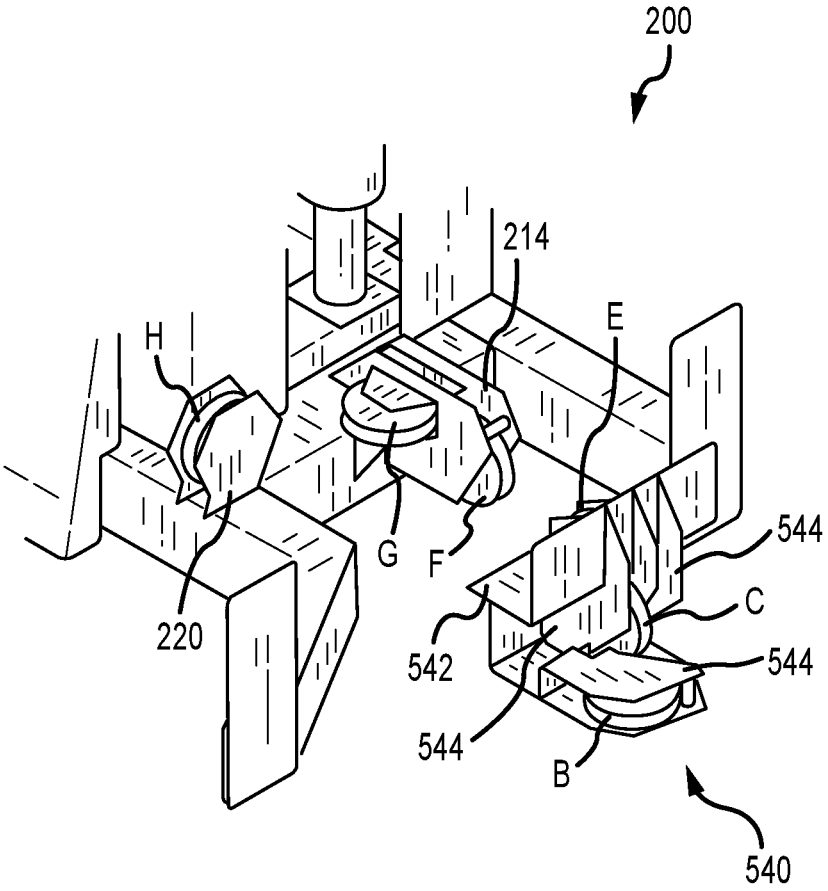
FIG. 7 depicts a partial enlarged upper perspective view of a base structure and a lower outer pulley bracket unit of the weightlifting system of FIG. 2.
Figure 8:
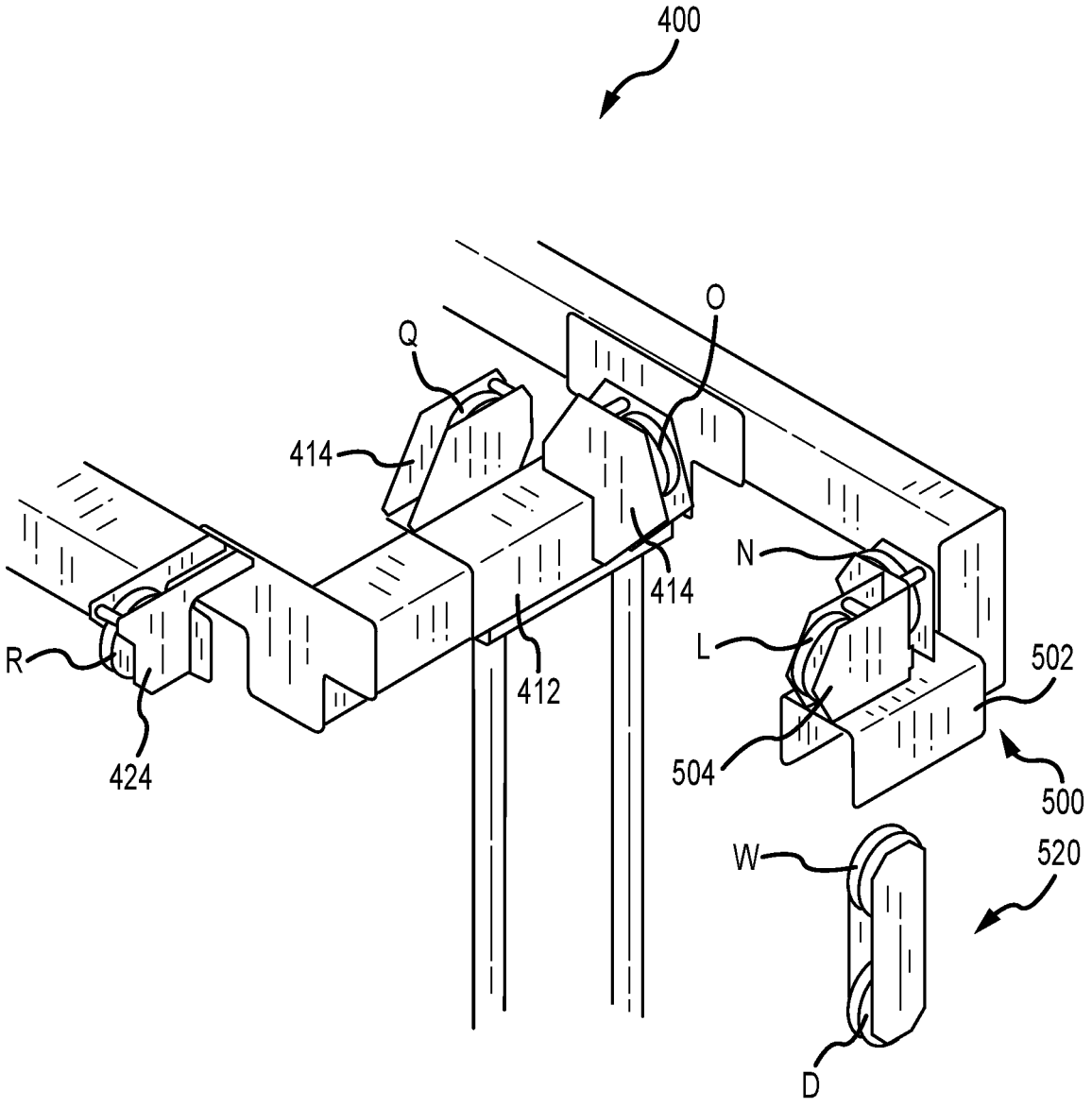
FIG. 8 depicts a partial enlarged upper perspective view of an upper structure, upper outer pulley bracket unit, and a floating pulley unit of the weightlifting system of FIG. 2.
Figure 9:
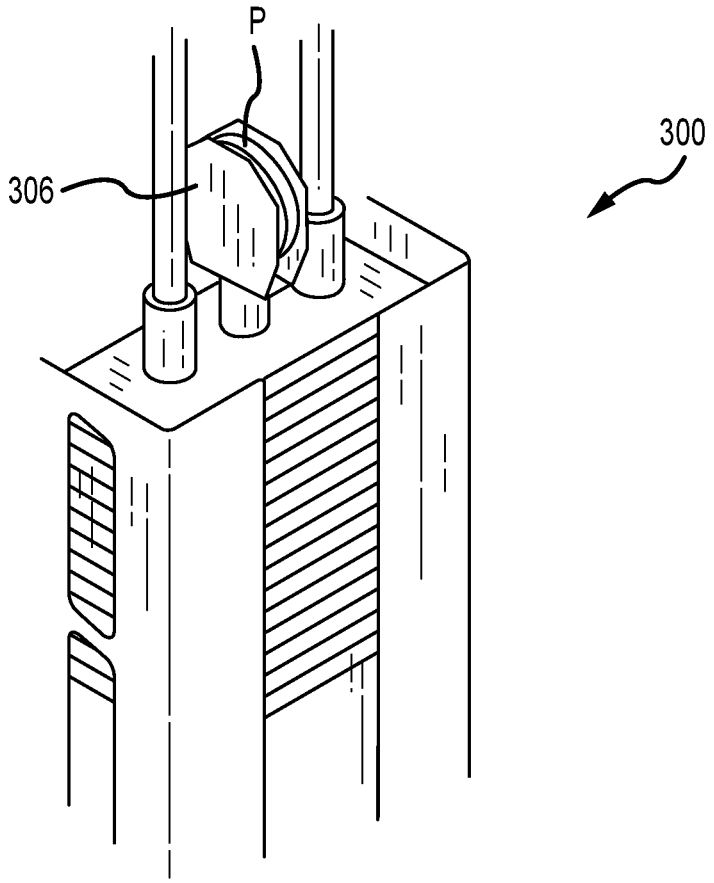
FIG. 9 depicts an enlarged upper perspective view of a weight system of the weightlifting system of FIG. 2.
Figure 10:
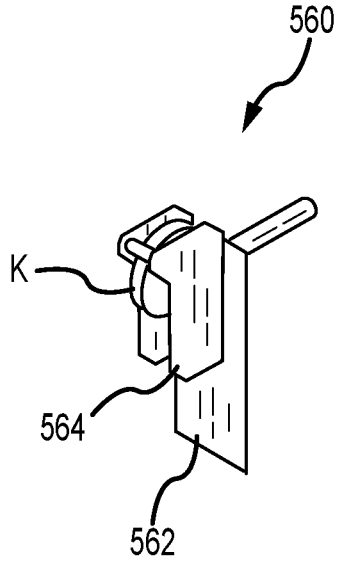
FIG. 10 depicts an enlarged upper perspective view of a front upper pulley bracket unit of the weightlifting system of FIG. 2.
Figure 11:
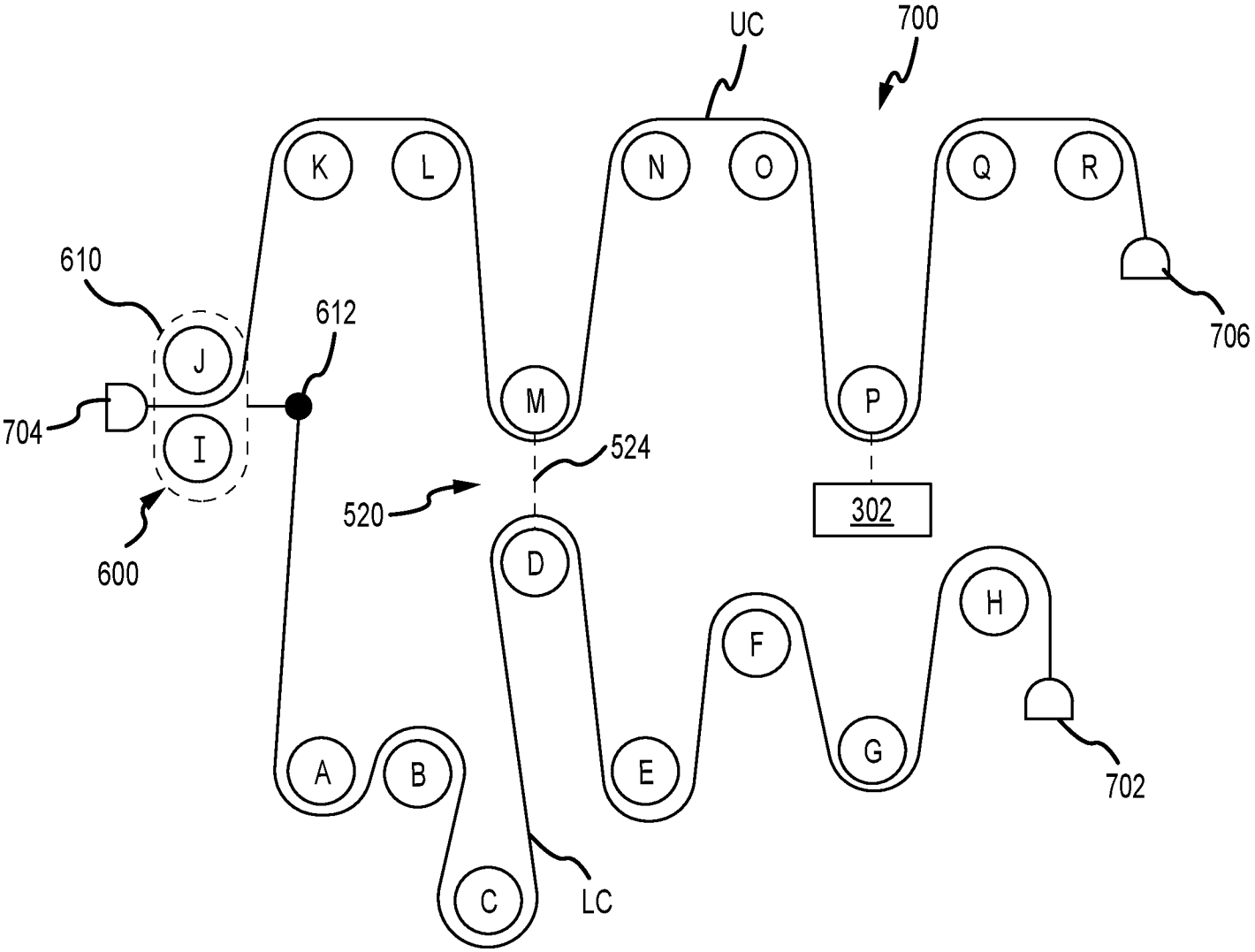
FIG. 11 depicts a schematic drawing of a cable routing configuration for the weightlifting system of FIG. 2.

FIGS. 6-10 depict, in relevant part, enlarged views of various pulleys of the weightlifting system of FIG. 2. The numbering used in FIGS. 6-10 is consistent with that used in FIGS. 1-5, except specific pulleys and rollers are designated by letters A-R. FIGS. 6-10 depict pulleys and rollers A-R, as described in the context of the cable routing configuration 700 depicted in FIG. 11. FIG. 11 depicts a schematic cable routing configuration 700 on a single side of the weightlifting system 100, connecting pulleys A-R. A mirror image of the cable routing configuration 700 is present on the opposite side of the weightlifting system 100. Only certain other components are depicted and described. Further, the cable routing configuration 700 is for illustrative purposes only; that is, a person of ordinary skill in art, upon reading this disclosure, would understand whether a cable wraps around a certain perimeter portion of a particular pulley or roller, based on the entrance position and exit position of the cable, relative to the pulley or roller. The cable routing configuration 700 includes a lower cable LC and an upper cable UC.

Lower cable LC is anchored at one end to anchor 612, which is secured to trolley housing 610. It then is passed around pulleys A, B, and C, before being passed around pulley D, in the floating pulley unit housing 524, which also includes therein pulley M. Lower cable LC is then passed around pulleys E, F, G, and H. After pulley H, a second end of lower cable LC may be connected to a first handle 702. A second handle 704 is at a first end of upper cable UC. Upper cable passes between pulleys I and J in trolley housing 610, then passes around pulleys K and L, before being passed around pulley M, in the floating pulley unit housing 524. Upper cable UC is then passed around pulleys N and O, before passing around pulley P, the actuation of which raises and lowers the weight stack unit 302. Thereafter, the upper cable passes around pulleys Q and R. A second end of upper cable UC is connected to a third handle 706. Since the lower cable LC is anchored at an anchor 612 to the trolley housing 610, movement of the trolley 600 up or down on the frame Fr causes a corresponding movement of the floating pulley unit 520, to take up the slack of either cable LC, UC. Pulling of any handle 702, 704, 706 moves the weight stack unit 302 up, providing resistance to a user of the weightlifting system 100.

It is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular examples only and is not intended to be limiting. It must be noted that, as used in this specification, the singular forms "a," "an," and "the" include plural referents unless the context clearly dictates otherwise.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified examples and examples. In this regard, any number of the features of the different examples described herein may be combined into one single example and alternate examples having fewer than or more than all of the features herein described are possible.

While various examples have been described for purposes of this disclosure, various changes and modifications may be made which are well within the scope contemplated by the present disclosure. Numerous other changes may be made which will readily suggest themselves to those skilled in the art and which are encompassed in the spirit of the disclosure.

What is claimed is:

1. An exercise system comprising:

a base structure comprising:

a first cross brace comprising first cross brace mounting plates disposed at each end of the first cross brace;

a pair of base guide rail supports secured to and extending substantially orthogonal from the first cross brace, wherein each of the pair of base guide rail supports comprise a pair of base guide rail receivers;

a pair of base pulley supports secured to and extending substantially orthogonal from the first cross brace, wherein each of the pair of base pulley supports further comprises:

a pulley-support pulley housing; and a pair of pulley-support pulleys rotatably secured to the pulley-support pulley housing; and a second cross brace comprising:

a central portion substantially parallel to the first cross brace, wherein the central portion is secured to the pair of base guide rail supports and the pair of base pulley supports;

two end portions disposed at an angle to the central portion, wherein each of the two end portions terminate at second cross brace mounting plates disposed at each end of the two end portions;

two central-portion pulley housings; and two central-portion pulleys each rotatably secured to a respective one of the two central-portion pulley housings; and a pair of weight stack units configured to seat upon the pair of base guide rail supports, respectively, wherein each of the pair of weight stack units comprises:

a pair of weight stack guide rails, wherein each of the pair of weight stack guide rails are secured at lower ends to a respective one of the pair of base guide rail receivers on a same one of the pair of base guide rail supports;

a movable weight stack slidably engaged with the pair of weight stack guide rails;

a lifting rod selectively engageable with the movable weight stack; and a weight stack pulley connected to the lifting rod;

wherein the first cross brace, the pair of base guide rail supports, the pair of base pulley supports, and the second cross brace each reside within a first single plane.

2. The exercise system of claim 1, further comprising:

an upper structure comprising:

a third cross brace comprising third cross brace mounting plates disposed at each end of the third cross brace;

a pair of upper guide rail supports secured to and extending substantially orthogonal from the third cross brace, wherein each of the pair of upper guide rail supports comprise a pair of upper guide rail receivers, and wherein each of the pair of weight stack guide rails are secured at upper ends to a respective one of the pair of upper guide rail receivers on a same one of the pair of upper guide rail supports;

two pulley support plates each fixed to a respective one of the pair of upper guide rail supports, wherein each pulley support plate comprises a pair of pulley-support plate pulley housings and a pair of pulley-support plate pulleys, wherein each pulley-support plate pulley of each of the pairs of pulley-support plate pulleys is rotatably secured to a respective pulley-support plate pulley housing of each of the pairs of pulley-support plate pulley housings; and a fourth cross brace comprising:

two end plates, wherein each of the two end plates is secured to a single respective one of the pair of upper guide rail supports;

a spanner connected to each of the two end plates;

two spanner pulley housings secured to the spanner; and a respective spanner pulley rotatably secured to each of the two spanner pulley housings.

3. The exercise system of claim 2, further comprising a frame connected to and extending between each of the base structure and the upper structure;

a pair of upper outer pulley bracket units connected to the frame, each comprising a bracket, a pair of upper outer pulley housings secured to the bracket, and a pair of upper outer pulleys, wherein each upper outer pulley of each of the pairs of upper outer pulleys is rotatably secured to a respective upper outer pulley housing of each of the pairs of upper outer pulley housings.

4. The exercise system of claim 3, further comprising a pair of lower outer pulley bracket units connected to the frame, each comprising a bracket, three lower outer pulley housings secured to the bracket, and three lower outer pulleys, wherein each of the three lower outer pulleys of each of the pair of lower outer pulley bracket units is rotatably secured to a respective one of the three lower outer pulley housings.

5. The exercise system of claim 4, further comprising two floating pulley units each disposed between a respective upper outer pulley bracket unit of the pair of upper outer pulley bracket units and a respective lower outer pulley bracket unit of the pair of lower outer pulley bracket units, wherein each floating pulley unit comprises a pair of floating pulleys rotatably coupled to a floating pulley housing.

6. The exercise system of claim 5, further comprising:

a pair of front upper pulley bracket units attached to upper portions of the frame, wherein each of the pair of front upper pulley bracket units comprises a bracket, a housing secured to the bracket, and a front upper pulley rotatably secured to the housing; and a pair of front lower pulley bracket units attached to lower portions of the frame beneath a respective front upper pulley bracket unit, wherein each of the front lower pulley bracket units comprises a bracket, a housing secured to the bracket, and a front lower pulley rotatably secured to the housing.

7. The exercise system of claim 6, further comprising:

two trolleys, each disposed between a respective front upper pulley bracket unit of the pair of front upper pulley bracket units and a respective front lower pulley bracket unit of the pair of front lower pulley bracket units, wherein each trolley comprises:

a receiver;

a pin coupled to the receiver for selectively securing the receiver to the frame;

a handle secured to the receiver; and a roller rotatably secured to the receiver.

8. The exercise system of claim 7 further comprising:

a first pair of cables moveably terminating at respective first ends at respective ones of the two trolleys, moveably terminating at respective second ends at respective ones of the two spanner pulleys, and traveling around respective ones of the front upper pulleys, upper pulleys in the pairs of floating pulleys, the single floating pulley, and the pulley support-plate pulleys; and a second pair of cables fixedly terminating at respective first ends at respective ones of the two trolleys, moveably terminating at respective second ends at respective ones of the two central portion pulleys, and traveling around respective ones of the front lower pulleys, lower pulleys in the pairs of floating pulleys, the pair of pulley-support pulleys, and the two central portion pulleys.

9. The exercise system of claim 6, further comprising a cable for rotatably coupling any two pulleys between one each of the front upper pulleys, the front lower pulleys, the pairs of floating pulleys, the three lower outer pulleys, the pairs of upper outer pulleys, the pair of pulley-support plate pulleys, the spanner pulleys, the two central-portion pulleys, or the pair of pulley-support pulleys.

10. The exercise system of claim 4, wherein a first rotational axis of one of the three pulleys in each lower pulley bracket unit is orthogonal to second and third rotational axes of the others of the three pulleys, respectively.

11. The exercise system of claim 2, wherein the third cross brace, the fourth cross brace, and the pair of upper guide rail supports of the upper structure each reside within a single second plane.

12. The exercise system of claim 1, wherein the base structure further comprises a foot plate slidably secured to the central portion of the second cross brace of the base structure.

* * * * *